US012385684B2

(12) United States Patent
Karthik et al.

(10) Patent No.: US 12,385,684 B2
(45) Date of Patent: Aug. 12, 2025

(54) REFRIGERATOR APPLIANCE

(71) Applicant: WHIRLPOOL CORPORATION, Benton Harbor, MI (US)

(72) Inventors: Sandhragiri Karthik, Pune (IN); Dariusz Ksyta, Wroclaw (PL); Andrea Olivani, Milan (IT); Weronika Ratajczyk, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 206 days.

(21) Appl. No.: 17/953,692

(22) Filed: Sep. 27, 2022

(65) Prior Publication Data

US 2024/0102721 A1 Mar. 28, 2024

(51) Int. Cl.

| | |
|---|---|
| ***F25D 21/08*** | (2006.01) |
| ***F25D 21/14*** | (2006.01) |
| ***F25D 23/00*** | (2006.01) |

(52) U.S. Cl.

CPC ..... *F25D 21/08* (2013.01); *F25D 21/14* (2013.01); *F25D 23/006* (2013.01)

(58) Field of Classification Search

CPC ..... F25D 2321/143; F25D 2321/1441; F25D 2321/1413; F25D 23/006; F25D 21/14; F25D 21/08; F25D 21/12; F28F 9/013; F28F 9/0131; F28F 1/32

See application file for complete search history.

(56) References Cited

U.S. PATENT DOCUMENTS

| | | | | |
|---|---|---|---|---|
| 3,599,442 | A * | 8/1971 | Hanson | F25D 17/065 62/285 |
| 3,783,635 | A | 1/1974 | Perez | |
| 4,061,482 | A * | 12/1977 | Smith | F25D 17/065 62/155 |
| 10,254,038 | B2 | 4/2019 | Jung | |
| 10,451,331 | B2 * | 10/2019 | Shin | F25D 17/065 |
| 10,731,911 | B2 | 8/2020 | Park et al. | |
| 2020/0408472 | A1 * | 12/2020 | Bae | F28F 9/013 |
| 2022/0146183 | A1 * | 5/2022 | Meza Silva | F25D 21/08 |

FOREIGN PATENT DOCUMENTS

| | | | |
|---|---|---|---|
| CN | 108344206 | A | 7/2018 |
| KR | 20020006201 | A | 1/2002 |

* cited by examiner

*Primary Examiner* — Tavia Sullens
(74) *Attorney, Agent, or Firm* — Brooks Kushman P.C.

(57) ABSTRACT

A refrigerator includes an evaporator, a drain pan, a heater tube, and a bracket. The evaporator has refrigerant tubes configured to route refrigerant through the evaporator and fins configured to facilitate heat exchange between the refrigerant and air being directed across the evaporator. The drain pan is configured to receive condensation formed on an exterior of the evaporator. The heater tube has a first section that is internal relative to first and second ends of the evaporator. The heater tube has a second section that is external relative to first and second ends of the evaporator. The second section extends to the drain pan. The bracket is secured to the evaporator, engages the second section of the heater tube, and biases the second section of the heater tube into engagement with the drain pan.

14 Claims, 7 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, an evaporator, a drain pan, a heater tube, and a bracket. The cabinet defines an internal cavity configured to store food items. The evaporator is configured to cool the internal cavity. The evaporator has a plurality of tubes configured to route refrigerant through the evaporator and a plurality of fins configured to facilitate heat exchange between the refrigerant flowing through the plurality of tubes and air that is being directed across the evaporator and into the internal cavity. The drain pan is disposed below the evaporator and is configured to catch condensation forming on and falling from the evaporator. The heater tube has a first portion winding through openings defined by the fins. The heater tube has a second portion extending from the first portion. The second portion is in contact with the drain pan. The heater tube is configured to prevent the formation of ice on and remove ice from the evaporator and the drain pan. The bracket is secured to the evaporator, engages the second portion of the heater tube, and biases the second portion of the heater tube into engagement with the drain pan.

A refrigerator includes an evaporator, a drain pan, a heater tube, and a bracket. The evaporator has refrigerant tubes configured to route refrigerant through the evaporator and fins configured to facilitate heat exchange between the refrigerant and air being directed across the evaporator. The drain pan is configured to receive condensation formed on an exterior of the evaporator. The heater tube has a first section that is internal relative to first and second ends of the evaporator. The heater tube has a second section that is external relative to first and second ends of the evaporator. The second section extends to the drain pan. The bracket is secured to the evaporator, engages the second section of the heater tube, and biases the second section of the heater tube into engagement with the drain pan.

A refrigerator includes a heat exchanger, a pan, a heating element, and a bracket. The heat exchanger has an array of tubes configured to route refrigerant through the heat exchanger. The pan is configured to catch condensation formed on an exterior of the heat exchanger. The heating element is secured to the heat exchanger and has a protruding portion extending from the heat exchanger to the pan. The bracket is secured to the heat exchanger, engages the protruding portion, and biases the protruding portion into engagement with the pan.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
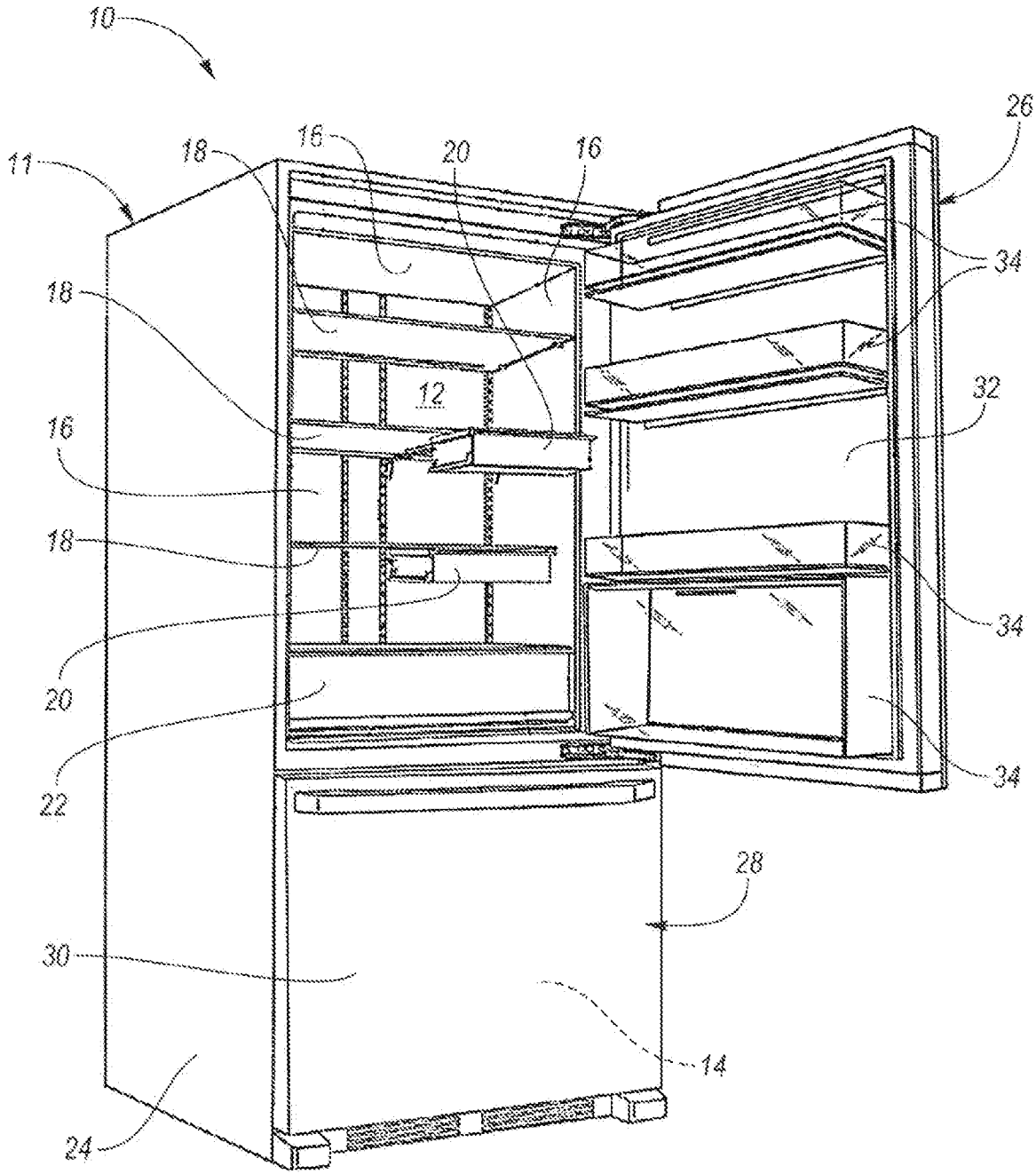
FIG. 1 is an isometric view of a bottom-mount type refrigerator appliance with the refrigeration compartment door open.

Referring to FIG. 1, generally a refrigerator 10 of the two-door bottom mount type is illustrated. However, it should be understood that this disclosure could apply to any type of refrigerator, such as a side-by-side, French-Door Bottom Mount, or a top-mount type. As shown in FIG. 1, the refrigerator 10 may have a first internal cavity, first internal storage chamber, or fresh food compartment 12 configured to refrigerate and not freeze consumables within the fresh food compartment 12, and a second internal cavity, second internal storage chamber, or a freezer compartment 14 configured to freeze consumables within the freezer compartment 14 during normal use. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes panels or internal walls 16 that define the fresh food compartment 12 and the freezer compartment 14. The walls 16 may more specifically form an internal liner of the refrigerator 10. The walls 16 may include a rear or back wall, a top wall, a bottom wall, and two side walls. One or more shelves 18 may be secured to the walls 16 within the fresh food compartment 12. One of more drawers 20 may be slidably secured to the shelves 18 or the walls 16 within the fresh food compartment 12. A crisper drawer 22 may be slidably secured to the shelves 18 or the walls 16 within the fresh food compartment 12. The crisper drawer 22 may more specifically be a drawer defining a storage space that is kept at a desired humidity that may be different from the remainder of the fresh food compartment 12, but that is optimal for maintaining freshness of fruits and vegetables.

The refrigerator 10 includes an outer shell, frame, or housing that comprises several exterior panels or walls 24. The outer shell, frame, or housing that comprises several exterior panels or walls 24 may also be referred to as the refrigerator cabinet wrapper. The exterior walls 24 may include a rear or back wall, a top wall, a bottom wall, and two side walls. The two side walls may be referred to as first and second side walls. An insulating material, such as an insulating foam, may be disposed between each exterior wall 24 and an adjacent corresponding interior wall 16 in order reduce the heat transfer from the ambient surroundings to the fresh food compartment 12 and the freezer compartment 14, which increases the efficiency of the refrigerator 10. Each exterior wall 24, adjacent corresponding interior wall 16, and the insulating material disposed therebetween may be collectively referred to as a single wall. The exterior walls 24, interior walls 16, and the insulating material may collectively form the cabinet 11 of the refrigerator 10. The cabinet 11 may define the fresh food compartment 12 and the freezer compartment 14.

The refrigerator 10 may have one or more doors 26, 28 that provide selective access to the interior volume of the refrigerator 10 where consumables may be stored. As shown, the fresh food compartment door is designated 26, and the freezer door is designated 28. The doors 26, 28 may be rotatably secured to the frame or housing of the refrigerator 10 by one or more hinges.

The doors 26, 28 may each include an exterior panel 30 and an interior panel 32 that is disposed on an internal side of the respective exterior panel 30 of each door 26, 28. The interior panels 32 may be configured to face the fresh food compartment 12 and freezer compartment 14 when the doors 26, 28 are in closed positions. The interior panels 32 may more specifically be door liners. An insulating material, such as an insulating foam, may be disposed between the exterior panels 30 and an adjacent corresponding interior panel 32 of each door 26, 28 in order reduce the heat transfer from the ambient surroundings and increase the efficiency of the refrigerator 10.

The doors 26, 28 may also include storage bins 34 that are able to hold food items or containers. The storage bins 34 may be secured to the interior panels 32 of each door 26, 28. Alternatively, the storage bins 34 may integrally formed within or defined by the interior panels 32 of each door 26, 28. In yet another alternative, a portion of the storage bins 34 may be secured to the interior panels 32 the doors 26, 28, while another portion of the storage bins 34 may be integrally formed within or defined by the interior panels 32 the doors 26, 28. The storage bins 34 may include shelves (e.g., a lower surface upon, which a food item or container may rest upon) that extend from back and/or side surfaces of the interior panels 32 of the doors 26, 28.

Figure 2:
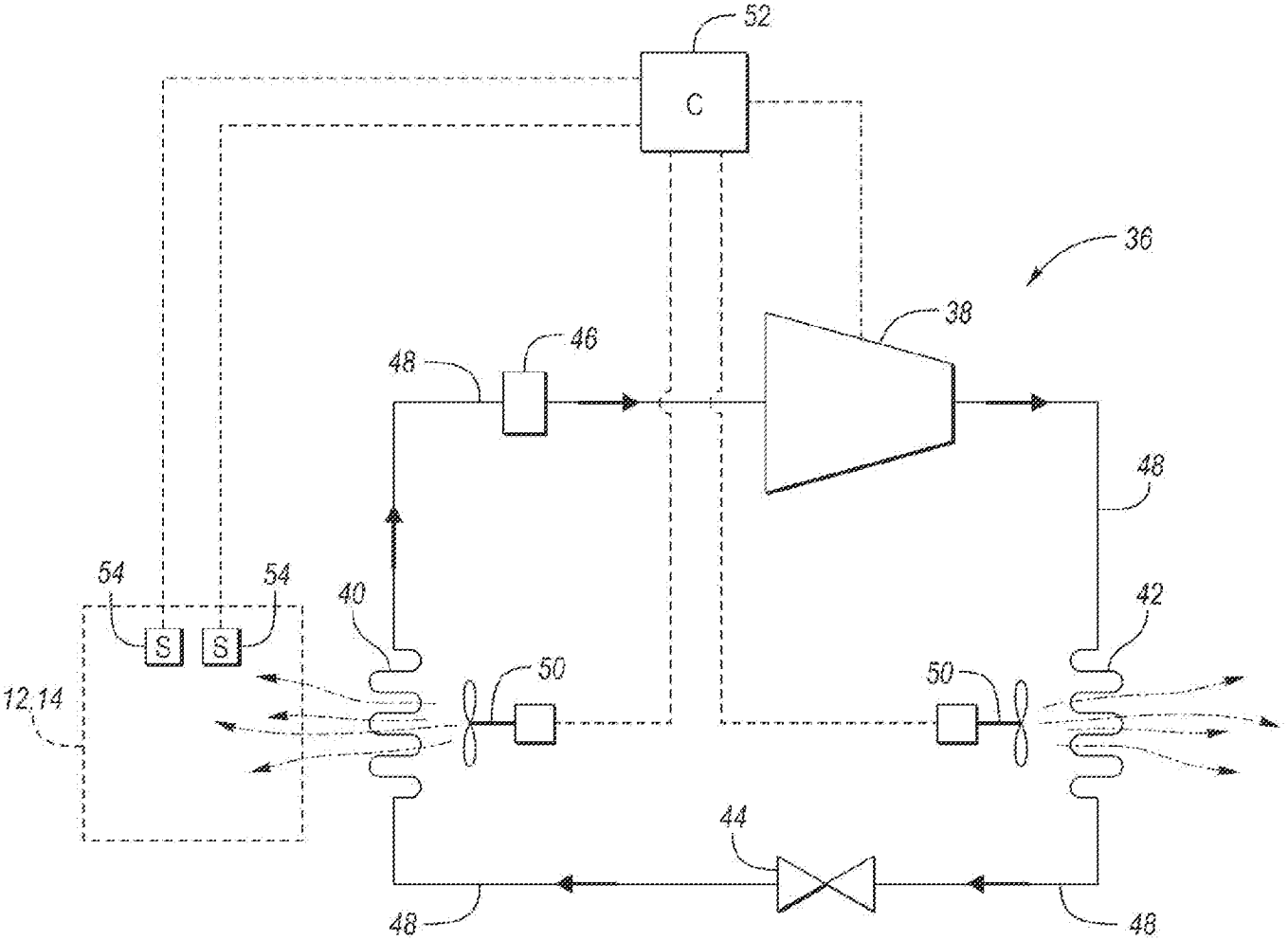
FIG. 2 is a diagram illustrating a refrigeration loop that is configured to cool the interior space (e.g., refrigerator compartment or freezer compartment) of the refrigerator and a control system configured to control the climate within the interior space of the refrigerator.
Figure 3:
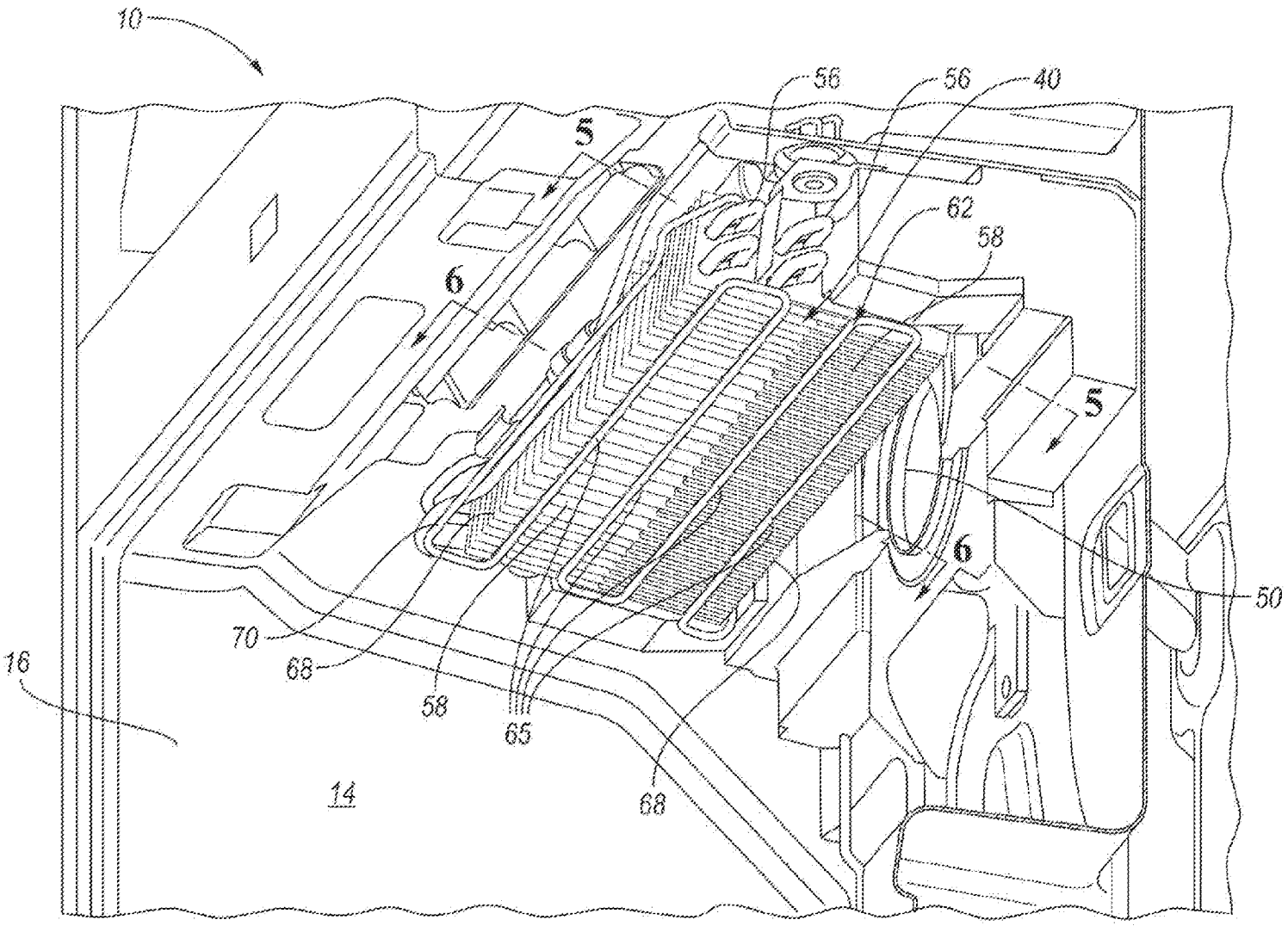
FIG. 3 is a lower isometric view of an evaporator installed within the refrigerator appliance.
Figure 4:
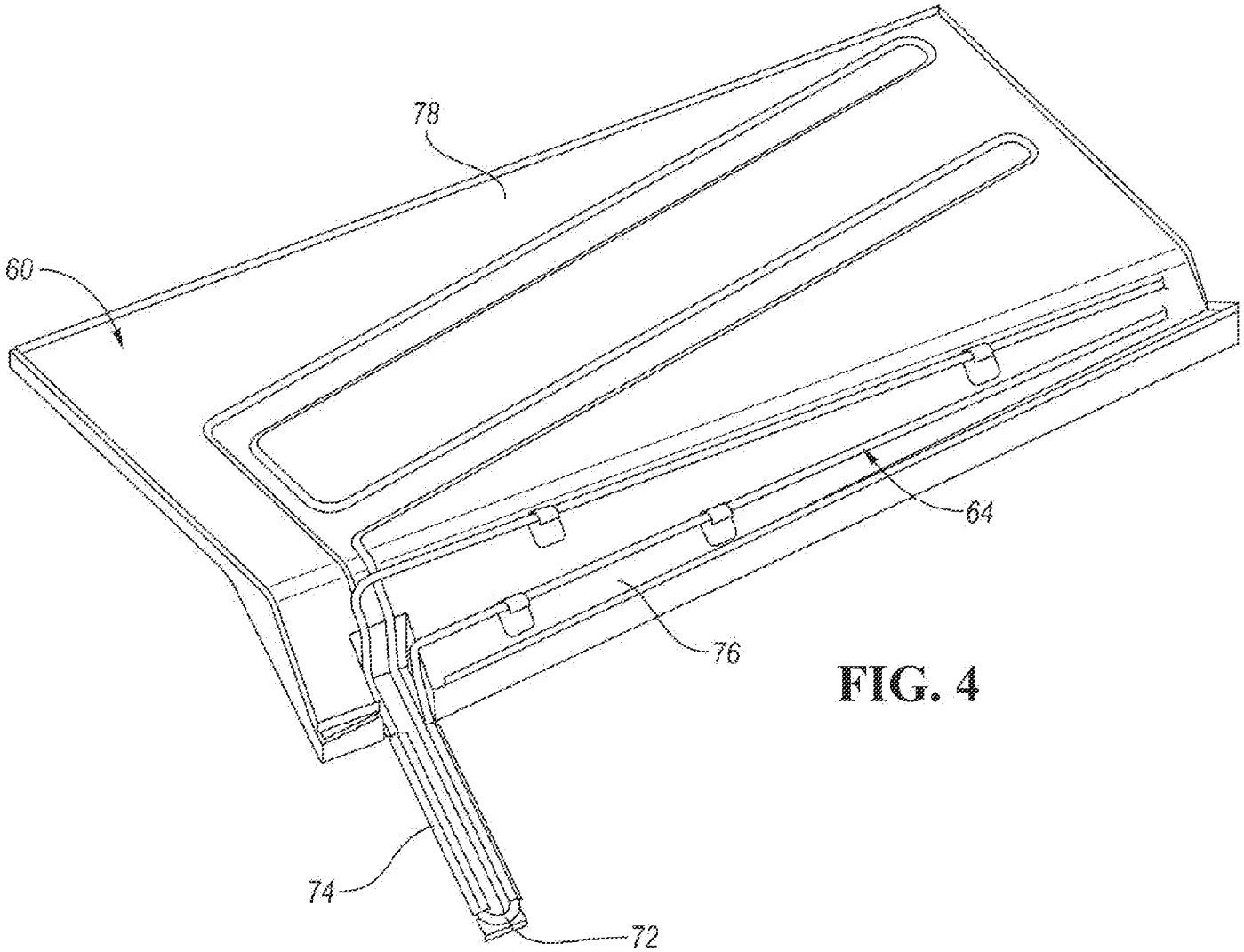
FIG. 4 is an upper isometric view of a drain pan assembly.
Figure 5:
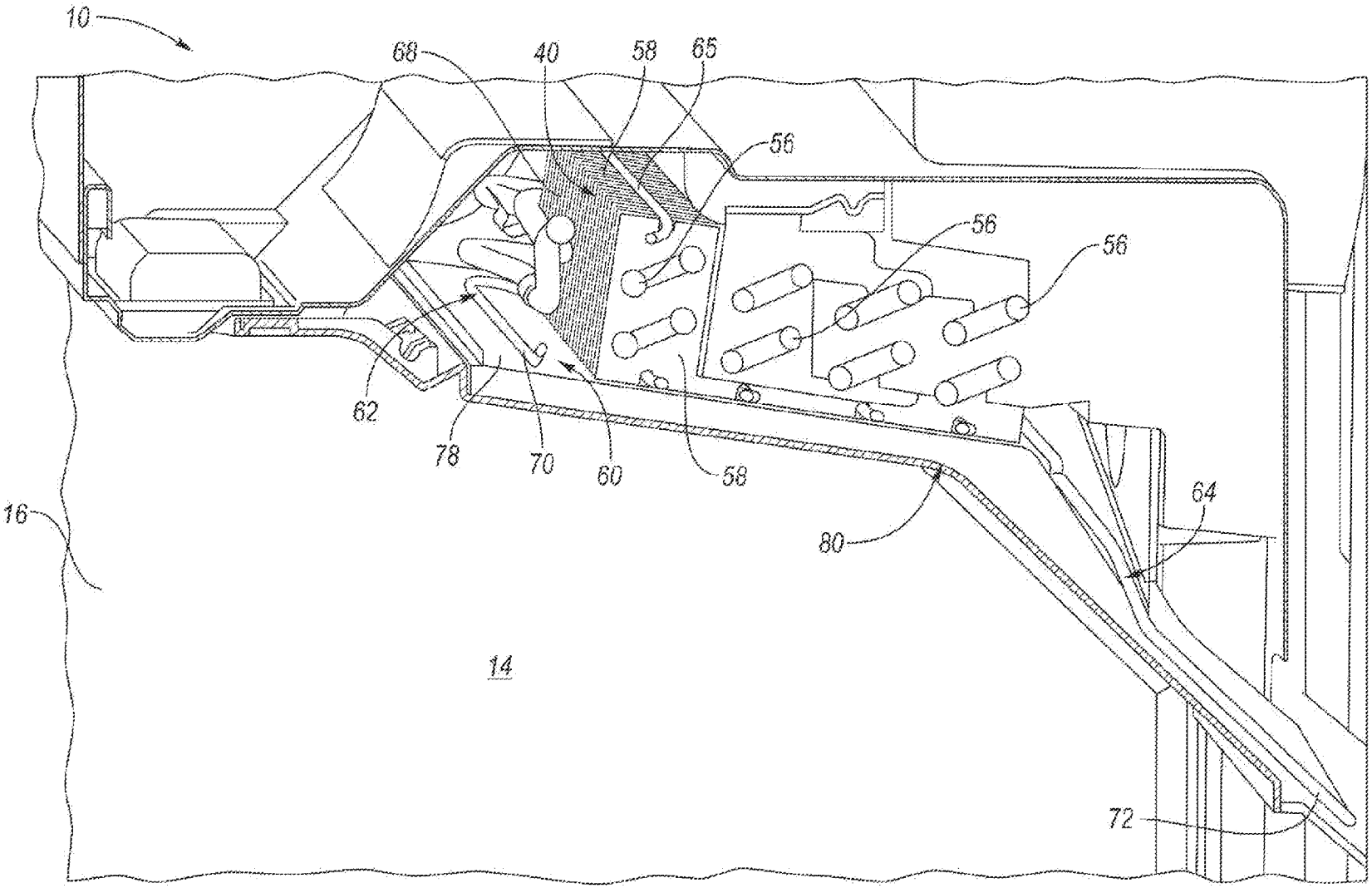
FIG. 5 is a cross-sectional view of the evaporator and the drain pan taken along line 5-5 in FIG. 3.
Figure 6:
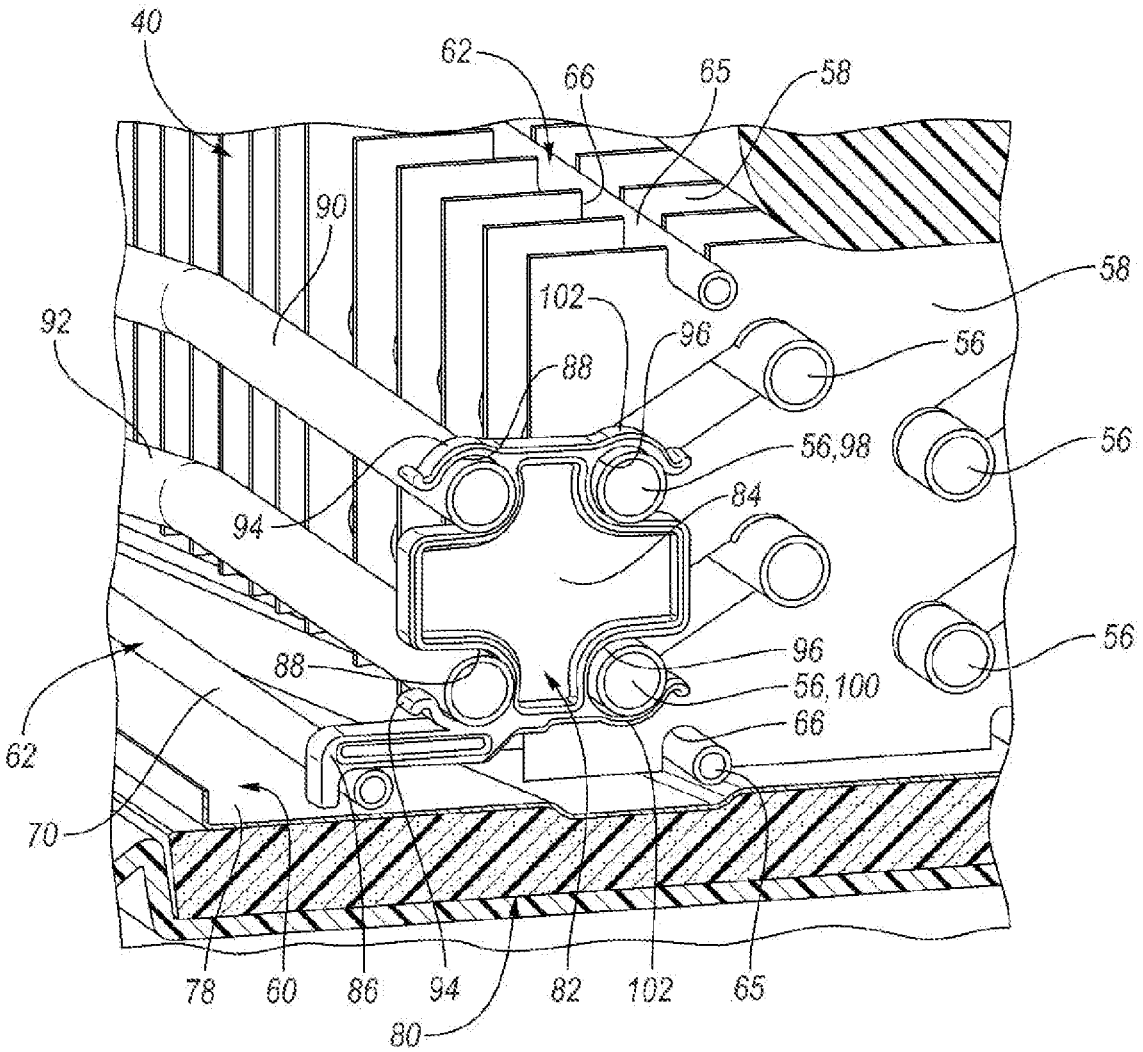
FIG. 6 is a magnified cross-sectional view illustrating a bracket that is configured to engage the evaporator and a heater taken along line 6-6 in FIG. 3.

Referring to FIG. 2, the refrigerator 10 includes a refrigeration loop or circuit 36 that is configured to cool the air the within the fresh food compartment 12 and the freezer compartment 14. The refrigeration loop or circuit 36 may also be referred to as a refrigerant loop or circuit. The refrigeration loop or circuit 36 includes at least a compressor 38, an evaporator 40 that cools air being delivered to the fresh food compartment 12 and/or the freezer compartment 14, a condenser 42 that rejects heat to ambient surroundings, and an expansion device such as a thermal expansion valve 44. The refrigeration loop or circuit 36 may also include an accumulator 46. The accumulator 46 may be located between the evaporator 40 and the compressor 38. The accumulator 46 prevents liquid refrigerant that did not evaporate in the evaporator 40 from flowing into the compressor 38. The refrigeration loop or circuit 36 includes lines or tubes 48 that are configured to transport the refrigerant between the evaporator 40, compressor 38, condenser 42, thermal expansion valve 44, and accumulator 46. The evaporator 40 and condenser 42 are each heat exchangers (e.g., tube and fin heat exchangers).

Fans 50 may be utilized to direct air across the evaporator 40 and the condenser 42 to facilitate exchanging heat. The compressor 38 and the fans 50 may be connected to a controller 52. Sensors 54 that measure the air temperature and/or humidity within the fresh food compartment 12 and the freezer compartment 14 may be in communication with the controller 52. The controller may be configured to operate the compressor 38, fans 50, etc. in response to the air temperature and/or humidity within the within the fresh food compartment 12 and the freezer compartment 14 being less than a threshold.

The controller 52 may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller 52 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 52 in controlling the refrigerator 10.

Control logic or functions performed by the controller 52 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller, such as controller 52. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

Referring to FIGS. 3-6, the evaporator 40 and associated subcomponents of the refrigerator 10 that may interact with the evaporator 40 are illustrated in further detail. The evaporator 40 has an array or plurality of refrigerant tubes 56 that are configured to route refrigerant through the evaporator 40. The evaporator 40 also includes a plurality of fins 58 that are configured to facilitate heat exchange between the refrigerant flowing through the plurality of refrigerant tubes 56 and air that is being directed across the evaporator 40 and into the internal cavity (e.g., the fresh food compartment 12 or the freezer compartment 14). A drain pan 60 is disposed below the evaporator 40. It is noted that the drain pan 60 has been removed in FIG. 3 for illustrative purposes. The drain pan 60 is configured to receive condensation formed on an exterior of the evaporator 40. More specifically, the drain pan 60 is configured to catch condensation that has formed on and then subsequently fallen downward from an exterior of the evaporator 40.

A first heater 62 and a second heater 64 are configured to prevent the formation of ice on and remove ice and from the evaporator 40 and the drain pan 60. The first heater 62 and the second heater 64 may be referred to as defrost heaters. The first heater 62 and the second heater 64 may each comprise winding or bent heating elements or heating tubes. The winding or bent heating elements or heating tubes may form loops. The first heater 62 is secured to the evaporator 40. The first heater 62 includes a first section or portion 65 winding through openings 66 defined by the plurality of fins 58 of the evaporator. The openings 66 may be slots, notches, through holes, etc. The first portion 65 is internal relative to first and second ends 68 of the evaporator 40. The first and second ends 68 of the evaporator 40 may be lateral ends or edges of the evaporator 40. The first heater 62 also includes a second section or portion 70 extending from the first portion 65. The second portion 70 extends to and may be in contact with the drain pan 60. The second portion 70 may be referred to as the protruding portion of the first heater 62 and is external relative to first and second ends 68 of the evaporator 40. The second portion 70 may comprise one of the loops of the winding or bent heating elements or heating tubes that form the first heater 62.

The first heater 62 is attached to the evaporator 40 and may be more specifically configured to prevent the formation of ice on and remove ice and from the evaporator 40. The second heater 64 is attached to the drain pan 60 and may be more specifically configured to prevent the formation of ice on and remove ice and from the drain pan 60. The second heater 64 includes an extending or protruding portion 72 that extends into a funnel 74. The funnel 74 is configured to route any water away from the drain pan 60. The second heater 64 may be even more specifically secured to a lower end 76 of the drain pan 60. Therefore, in order to ensure proper heating of an upper end 78 of the drain pan 60 to prevent the formation of ice on the upper end 78 of the drain pan 60, the second portion 70 of the first heater 62 may be placed into contact with the upper end 78 of the drain pan 60.

During the assembly process, once the evaporator 40 is secured inside the internal cavity (e.g., the fresh food compartment 12 or the freezer compartment 14), the cover sub-assembly 80, which includes the drain pan 60, can be installed, allowing the second portion 70 of first heater 62 to be in contact with the drain pan 60. If the second portion 70 of the first heater 62 is kept in contact with the drain pan 60, the heat generated by the first heater 62 is spread efficiently in front of the evaporator 40 eliminating the risk of ice accumulating on the drain pan 60. In the event that the second portion 70 of the first heater 62 is not placed into proper contact with the drain pan 60 during assembly or if the second portion 70 of the first heater 62 is accidently deformed or bent, a reduction in the contact area between second portion 70 of the first heater 62 and drain pan 60 could result, increasing the risk of ice accumulation on the drain pan 60 or other portions of the cover assembly 80.

In order to ensure proper contact between the second portion 70 of the first heater 62 and the drain pan 60, a bracket 82 may be utilized to properly position the second portion 70 of the first heater 62 such that the second portion 70 of the first heater 62 remains in contact with the drain pan 60. The bracket 82 is secured to the evaporator 40. The bracket engages the second portion 70 of the first heater 62 and biases the second portion 70 of the first heater 62 into engagement (e.g., contact with) with the drain pan 60. The bracket 82 includes a main body 84 and a biasing arm 86 protruding from the main body 84. The biasing arm 86 engages the second portion 70 of the first heater 62 and biases the second portion 70 of the first heater 62 into engagement with the drain pan 60.

The bracket 82 also defines one or more first slots 88 that are configured to receive and maintain positions of an inlet tube 90 and an outlet tube 92 of the evaporator 40. The inlet and outlet tubes 90, 92 are configured to respectively direct the refrigerant from an adjacent component (e.g., the thermal expansion valve 44) to the plurality of refrigerant tubes 56 and direct the refrigerant from the plurality of refrigerant tubes 56 to an adjacent component (e.g., the accumulator 46 or compressor 38). The bracket 82 may also include one or more first clips 94 configured to retain the inlet and outlet tubes 90, 92 of the evaporator 40 within the one or more first slots 88. The one or more first clips 94 may be flexible such that the one or more first clips 94 flex outwards toward displaced positions during installation of the inlet and outlet tubes 90, 92 into the one or more first slots 88. Once the inlet and outlet tubes 90, 92 are disposed within the one or more first slots 88, the one or more first clips 94 may then inwardly snap back to original non-displaced positions to retain the inlet and outlet tubes 90, 92 within the one or more first slots 88.

The bracket 82 also defines one or more second slots 96 that are configured to receive a first tube 98 and a second tube 100 of the plurality of refrigerant tubes 56 of to secure the bracket 82 to the evaporator 40. The one or more second slots 96 may be defined on an opposing side of the bracket 82 relative to the one or more first slots 88. The first and second tubes 98, 100 may include an outer most pair of tubes of the plurality of refrigerant tubes 56. The bracket 82 may also include one or more second clips 102 configured to retain the first and second tubes 98, 100 within the one or more second slots 96. The one or more second clips 102 may be flexible such that the one or more second clips 102 flex outwards toward displaced positions during installation of the first and second tubes 98, 100 into the one or more second slots 96. Once the first and second tubes 98, 100 are disposed within the one or more second slots 96, the one or more second clips 102 may then inwardly snap back to original non-displaced positions to retain the first and second tubes 98, 100 within the one or more second slots 96. Although only one bracket 82 is illustrated, it should be understood that multiple brackets that are identical or similar in function to bracket 82 may be utilized.

Figure 7:
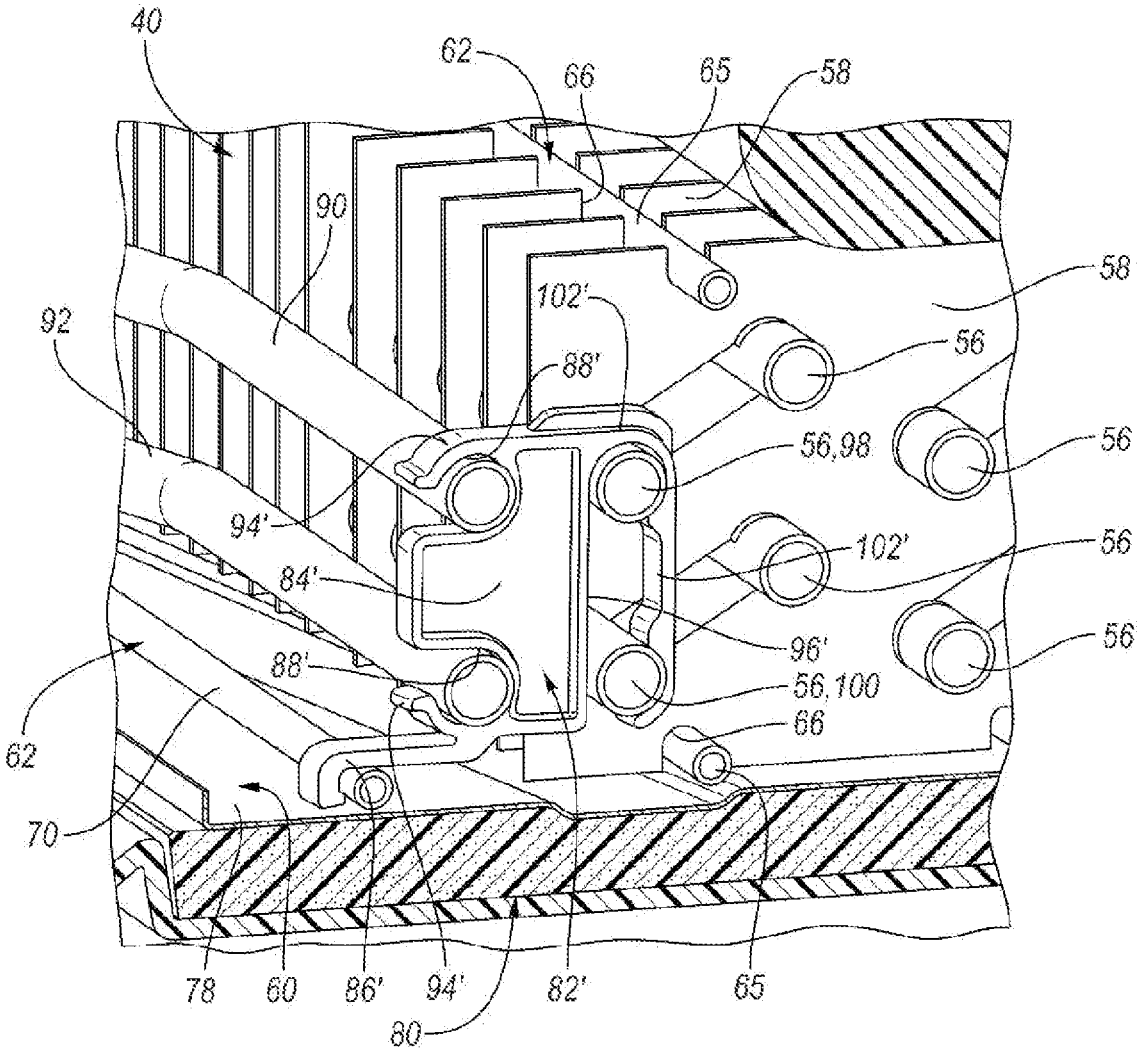
FIG. 7 is a magnified cross-sectional view illustrating an alternative embodiment of the bracket that is configured to engage the evaporator and the heater taken along line 6-6 in FIG. 3.

Referring to FIG. 7, an alternative bracket 82' is illustrated. It should be understood that bracket 82' has all the same subcomponents and functionality as bracket 82 unless otherwise stated or illustrated herein. Furthermore, it should be understood that any component having a callout number in FIG. 7 that includes a prime symbol (') should be construed as having the same structure, subcomponents, and functionality as a component illustrated in FIGS. 3-6 that includes the same callout number but without the prime symbol, unless otherwise stated or illustrated herein.

The bracket 82' includes a main body 84', a biasing arm 86', defines one or more first slots 88', includes one or more first clips 94', defines one or more second slots 96', and includes one or more second clips 102'. Bracket 82' is illustrated to define one second slot 96' and include one second clip 102', while bracket 82 is illustrated to define two second slots 96 and include two second clips 102. Although only one bracket 82' is illustrated, it should be understood that multiple brackets that are identical or similar in function to bracket 82' may be utilized.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining an internal cavity configured to store food items;

an evaporator (i) configured to cool the internal cavity, (ii) having a plurality of tubes configured to route refrigerant through the evaporator, and (iii) having a plurality of fins configured to facilitate heat exchange between the refrigerant flowing through the plurality of tubes and air that is being directed across the evaporator and into the internal cavity;

a drain pan disposed below the evaporator and configured to catch condensation forming on and falling from the evaporator;

a heater tube having (i) a first portion winding through openings defined by the fins and (ii) a second portion extending from the first portion and in contact with the drain pan, wherein the heater tube is configured to prevent formation of ice on and remove ice from the evaporator and the drain pan; and a bracket (i) secured to the evaporator, (ii) engaging the second portion of the heater tube, and (iii) biasing the second portion of the heater tube into contact with the drain pan, wherein (a) the bracket includes a main body and a biasing arm protruding from the main body, (b) the bracket engaging the second portion of the heater tube and biasing the second portion of the heater tube into contact the drain pan corresponds to the biasing am engaging the second portion of the heater tube and biasing the second portion of the heater tube into contact with the drain pan, and (c) the biasing arm engaging the second portion of the heater tube and biasing the second portion of the heater tube into contact with the drain pan corresponds to the biasing arm contacting a top of the second portion of the heater tube and biasing the second portion of the heater tube such that a bottom of the second portion of the heater tube contacts the drain pan.

2. The refrigerator of claim 1, wherein (i) the evaporator includes inlet and outlet tubes that are configured to respectively direct the refrigerant to and away from the plurality of tubes and (ii) the bracket defines at least one slot configured to receive and maintain positions of the inlet and outlet tubes of the evaporator.

3. The refrigerator of claim 2, wherein the bracket includes at least one clip configured to retain the inlet and outlet tubes of the evaporator within the at least one slot.

4. The refrigerator of claim 2, wherein the bracket defines at least one second slot configured to receive first and second tubes of the plurality of tubes to secure the bracket to the evaporator.

5. The refrigerator of claim 1, wherein the biasing arm contacts the second portion of the heater tube but is not affixed to the second portion of the heater tube.

6. A refrigerator comprising:

an evaporator (i) having refrigerant tubes configured to route refrigerant through the evaporator and (ii) fins configured to facilitate heat exchange between the refrigerant and air being directed across the evaporator;

a drain pan configured to receive condensation formed on an exterior of the evaporator;

a heater tube (i) having first section that is internal relative to first and second ends of the evaporator and (ii) a second section that is external relative to the first and second ends of the evaporator, the second section extending to the drain pan; and a bracket (i) secured to the evaporator, (ii) engaging the second section of the heater tube, and (iii) biasing the second section of the heater tube into contact with the drain pan, wherein (a) the bracket includes a main body and a biasing arm protruding from the main body (b) the bracket engaging the second section of the heater tube and biasing the second section of the heater tube into contact with the drain pan corresponds to the biasing arm engaging the second section of the heater tube and biasing the second section of the heater tube into contact with the drain pan, and (c) the biasing arm engaging the second section of the heater tube and biasing the second section of the heater tube into contact with the drain pan corresponds to the biasing arm contacting a top of the second section of the heater tube and biasing the second section of the heater tube such that a bottom of the second section of the heater tube contacts the drain pan.

7. The refrigerator of claim 6, wherein (i) the evaporator includes inlet and outlet tubes that are configured to respectively direct the refrigerant to and away from the refrigerant tubes and (ii) the bracket defines at least one slot configured to receive and maintain positions of the inlet and outlet tubes of the evaporator.

8. The refrigerator of claim 7, wherein the bracket includes at least one clip configured to retain the inlet and outlet tubes of the evaporator within the at least one slot.

9. The refrigerator of claim 7, wherein the bracket defines at least one second slot configured to receive first and second tubes of the refrigerant tubes to secure the bracket to the evaporator.

10. The refrigerator of claim 6, wherein the biasing arm contacts the second section of the heater tube but is not affixed to the second section of the heater tube heater tube.

11. A refrigerator comprising:

a heat exchanger having an array of tubes configured to route refrigerant through the heat exchanger;

a pan configured to catch condensation formed on an exterior of the heat exchanger;

a heater (i) secured to the heat exchanger and (i)) having a protruding portion extending from the heat exchanger to the pan, and a bracket (i) secured to the heat exchanger, (ii) engaging the protruding portion, and (iii) biasing the protruding portion into contact with the pan, wherein (a) the bracket includes a main body and a biasing arm protruding from the main body, (b) the bracket engaging the protruding portion and biasing the protruding portion into contact with the pan corresponds to the biasing arm engaging the protruding portion and biasing the protruding portion into contact vi the pan, and (c) the biasing arm engaging the protruding portion and biasing the protruding portion into contact with the pan corresponds to the biasing arm contacting a top of the protruding portion and biasing the protruding portion such that a bottom of the protruding portion contacts the pan.

12. The refrigerator of claim 11, wherein (i) the heat exchanger includes inlet and outlet tubes that are configured to respectively direct the refrigerant to and away from the array of tubes and (ii) the bracket defines at least one slot configured to: receive and maintain positions of the inlet and outlet tubes.

13. The refrigerator of claim 12, wherein the bracket includes at least one clip configured to retain the inlet and outlet tubes within the at least one slot.

14. The refrigerator of claim 11, wherein the biasing arm contacts the protruding portion but is not affixed to the protruding portion.

* * * * *